US006170123B1

(12) United States Patent
Holland-Letz

(10) Patent No.: US 6,170,123 B1
(45) Date of Patent: Jan. 9, 2001

(54) HANDLE FOR A HAND TOOL

(75) Inventor: Horst Holland-Letz, Neustadt (DE)

(73) Assignee: Felo Werkzeugfabrik Holland-Letz GmbH (DE)

( * ) Notice: Under 35 U.S.C. 154(b), the term of this patent shall be extended for 0 days.

(21) Appl. No.: 09/261,364

(22) Filed: Mar. 3, 1999

(30) Foreign Application Priority Data

Mar. 7, 1998 (DE) ..... 298 03 967 U

(51) Int. Cl.[7] ..... A45C 13/26; E05B 1/00

(52) U.S. Cl. ..... 16/436; 16/902; 16/430; 81/177.1; 81/489; 81/436

(58) Field of Search ..... 16/436, 431, 430, 16/900, 421, 903, 902; 81/177.1, 489, 436; D8/107, 83

(56) References Cited

U.S. PATENT DOCUMENTS

| | | | | |
|---|---|---|---|---|
| Re. 34,194 | * | 3/1993 | Stowell et al. | 16/430 |
| D. 379,750 | * | 6/1997 | Thompson et al. | D8/83 |
| D. 418,034 | * | 12/1999 | Ho | D8/83 |
| 2,564,356 | * | 8/1951 | Dianda | 81/436 |
| 4,093,008 | * | 6/1978 | Martin | 81/436 |
| 4,290,465 | * | 9/1981 | Fee et al. | 81/436 |
| 4,417,611 | * | 11/1983 | Kim | 81/75 |
| 4,739,536 | * | 4/1988 | Bandera et al. | 16/430 |
| 5,431,075 | * | 7/1995 | Cruz et al. | 81/177.1 |
| 5,551,323 | * | 9/1996 | Beere et al. | 81/489 |
| 5,823,078 | * | 10/1998 | Liu | 81/436 |
| 5,964,009 | * | 10/1999 | Hoepfl et al. | 16/430 |

* cited by examiner

*Primary Examiner*—Chuck Y. Mah
(74) *Attorney, Agent, or Firm*—Leydig, Voit & Mayer, Ltd.

(57) ABSTRACT

Disclosed is a tool handle for an electronic screwdriver or other hand tool. The tool handle includes a tool handle body having a longitudinal dimension and comprising a convex portion that comprises about ⅖ of the longitudinal dimension proximal to the grip of the handle body and a relatively soft concave portion comprising substantially all of the remaining ⅕ of the tool handle body proximal to the working end. The tool handle further including a cap disposed at the grip end of the tool handle body, which cap is rotatable relative to the tool handle body. A user may grip the tool handle in various positions to apply varying levels of torque to a screw or other workpiece. Preferably, the cap includes a dome-shaped recess at the grip end for centering of the tool between the fingertip and working end of the tool.

14 Claims, 3 Drawing Sheets

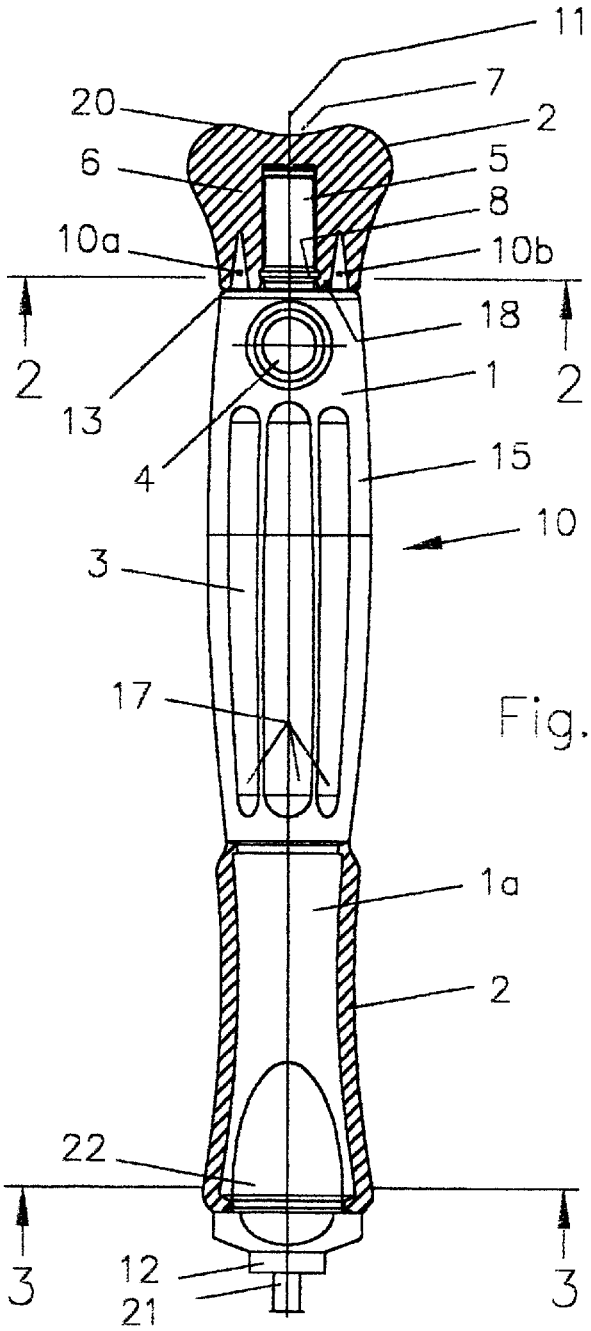
Fig.1
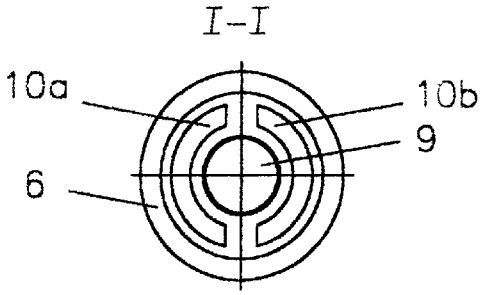
2-2
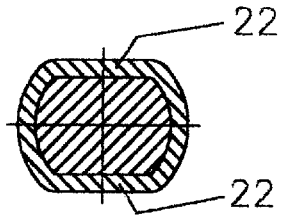
3-3

HANDLE FOR A HAND TOOL

TECHNICAL FIELD OF THE INVENTION

The present invention relates to a handle for a hand tool, particularly a handle suitable for use in conjunction with electronic screwdrivers and similar hand tools.

BACKGROUND OF THE INVENTION

Handles for electronic screwdrivers and the like conventionally are slim and have a small diameter to permit delicate work when tightening and loosening very small screws. Such handles typically are provided with a rotating cap having a dome-shaped recess in the end face of the cap for use in centering the hand tool between the fingertip and the working tip of the screwdriver.

Generally, only one handle size is provided for slotted screws having a contemplated range of blade edge widths of 0.8 to 4 mm., a range whose test moment of torsion ratio is approximately 1:20. Such known handles typically are made completely of a hard synthetic plastic material, or, particularly in conjunction with newer handle designs, are made of a basic body of hard synthetic plastic material whose surface is partially covered with a soft synthetic material. Handles made of hard synthetic material that do not have a surface of soft synthetic material do not meet the current requirements for an ergonomically correct tool handle design. Moreover, if the contour of the handle body is substantially derived from cylindrical or conical shapes, it will not meet current design requirements.

The prior art has provided different handles of this particular kind. One known handle consisting of two synthetic materials has a slightly convex contour over its total longitudinal extension up to the point where the handle body joins the rotatable end cap. This design does not differentiate between the contact area for the palm of the hand and that for the fingertips. For this reason, it is difficult to perform delicate work using the fingertips.

In another known handle consisting of two synthetic materials, the diameter is substantially very small over the entire length of the handle. At the front third, the handle is provided with an approximately barrel-shaped enlargement wherein soft synthetic material is provided in pockets in the handle distributed over the circumference of the handle. While one's fingers may find a good fit between the blade-side top of the handle and the barrel-shaped enlargement, the fit of the palm of the hand on the handle is inconvenient. Such good fit generally would be required for transferring somewhat higher moments of torsion, such as, for example, when tightening or loosening larger screws.

In light of these drawbacks of known electronic screwdrivers or handles for similar tools, there exists a need in the art for a more versatile handle for the special requirements of the application. It is a general object of the invention to design a handle of that kind, that generally gives a comfortable grip, and that provides a good support of the handle, both in the palm of the hand, and against the fingertips. The handle should permit centering between the working tip of the tool (such as a screwdriver tip) and the hand, and provide a sufficiently large, discontinuous area for imprinting of the handle. The handle should be able to accommodate primarily low-torque and medium-torque applications.

THE INVENTION

The present invention provides a handle for an electronic screwdriver or similar tool that meets the foregoing general object. In accordance with the invention, the tool handle made of a hard plastic material includes a tool handle body having a longitudinal dimension and having a working end and a grip end, the tool handle including a convex portion comprising about ⅗ of the longitudinal dimension of the handle body proximal the grip end and a concave portion comprising substantially of all of the remaining ⅖ of the longitudinal dimension of the handle body proximal the working end, the concave portion being coated with a soft plastic material. The screwdriver blade or other working tool may be injected into the basic handle body or, in another embodiment of the invention, the tool handle may include a shank at the working end with a device to hold exchangeable tool inserts. Connected to the tool handle body at the grip end is a cap, which is rotatable relative to the tool handle body. The cap is disposed at the grip end of the tool handle body, and preferably is connected via a snap-type connection. The connection between the tool handle body and cap is designed and has a tolerance such that the cap may rotate easily with respect to the tool handle body even under normal axial stresses. Preferably, the diameter of the cap increases relatively strongly in the direction of the grip end. Most preferably, the cap includes a dome-shaped centering recess in the end face, and the transition surface of the outer contour of the cap is well rounded off. The cap thus provides a good support for the palm of the hand, and the dome-shaped recess may be used for centering the tool between the fingertip and a workpiece (e.g., a screw). Further features and embodiments of the invention are described in the following description of the invention.

DESCRIPTION OF THE DRAWINGS

FIG. 1 is a partially plan view, partially cross-sectional top view of a tool handle in accordance with the invention, shown cut away at the cap.

FIG. 2 is a view of the cap viewed at line 2—2 in FIG. 1.

FIG. 3 is a cross-sectional view taken along lines 3—3 in FIG. 1.

DESCRIPTION OF THE PREFERRED EMBODIMENTS

Figure 4:
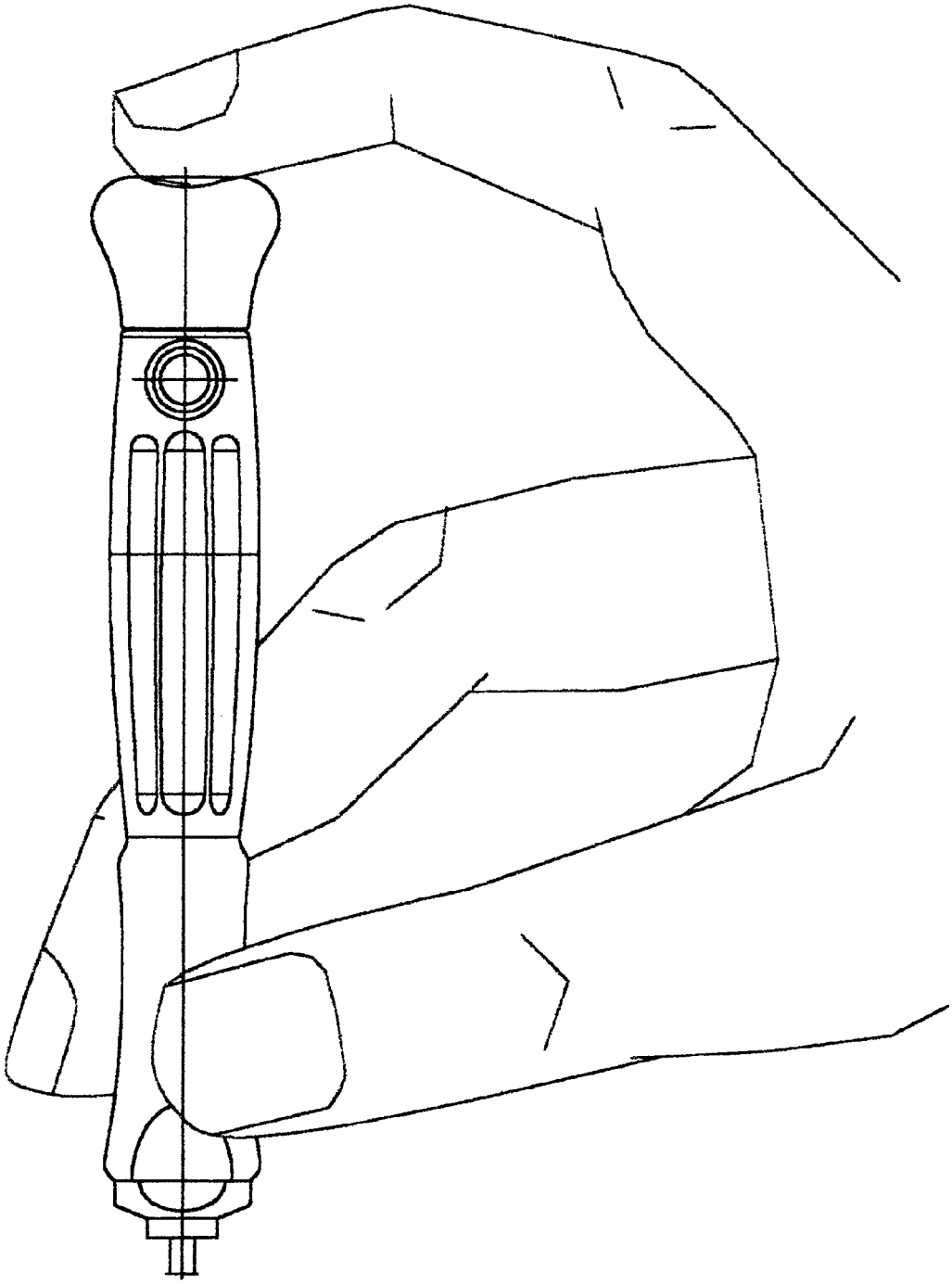
FIGS. 4 and 5 are perspective views that illustrate manual operation of the tool handle.

The invention provides a tool handle for electronic screwdrivers and other tools. With reference to FIG. 1, the tool handle 10 has a tool handle body 1 having a longitudinal axis 11, a working end 12, and a grip end 13. The tool handle body 1 includes a convex portion 15 proximal to the grip end 13, and a concave portion 1*a* proximal to the working end 12. The convex portion 15 is portion of the basic handle body that has a slightly convex contour which extends approximately ⅗ of the longitudinal dimension of the handle body. Substantially all of the remaining ⅖ of the tool handle body comprises the concave portion la. The convex portion 15 provides a surface suitable for imprinting of the tool handle. The tool handle in the embodiment illustrated in FIG. 1 includes a blade shank 21. The shank may terminate at a working tip, such as a screwdriver blade (not shown), or may include a retaining device (not shown) for holding exchangeable tool inserts.

In accordance with the invention, the concave portion 1*a* is soft relative to the convex portion 15. Preferably, the relative softness is provided by means of a coating 2 of a soft synthetic plastic material that covers the basic handle body. The coating may be applied to the handle body by means of injection molding, or, alternatively, may be provided in the form of a tube-shaped, separately produced part which is mounted on the basic handle body and which is connected thereto via non-positive or positive locking. The handle's working end portion includes a pair of flats 22 (best shown in FIG. 3) disposed at radially opposed positions to inhibit rolling of the handle on flat surfaces, such as a table.

Other then at the flats 22, the concave portion 1*a* preferably is of circuloid cross-section, that is, a given cross-section of infinitesimal thickness is circular to allow quick rotation of the handle between the tips of the thumb and middle finger. The convex portion 15 may have a circuloid or non-circuloid cross-section. In either event, the convex portion 15 preferably includes a transverse hanging hole 4. Most preferably, the convex portion 15 is provided with gripping flats 17 to thereby provide a non-circuloid gripping surface 3 to achieve a better transfer of torque from the palm of the hand to the handle when required.

Extending from the grip end 13 of the tool handle body 1 is a shaft 5 which includes an annular retaining ring 8. The tool handle is provided with a cap 6, the cap including a bore 9 (best shown in FIG. 2) for receiving the shaft 5. The bore 9 includes an annular recess for receiving the retaining ring 8 of the shaft 5 to thus provide a snap-fit connection between the cap 6 and the tool handle body 1 and to permit free rotation of the cap 6 on the shaft of the tool handle body 1.

Ease of rotation of the cap 6 on the shaft 5 can be achieved by precise adjustment of the tolerances between the shaft 5 and the bore 9. In a strong-walled injection molded part made of synthetic material, it is difficult or impossible to prepare a bore within the defined tolerance required. For this reason, the handle-side bottom of the cap preferably includes a plurality of generally segment-shaped recesses 10*a* and 10*b* as shown in FIGS. 1 and 2. The recesses are formed around the bore 9 and are arranged centrically. Alternation, the cap may be provided with a single circular recess (not shown). The provision of such recess or recesses causes the wall thickness in this area to reduce to such an extent that shrinking during molding minimal and the tolerance of the bore hole 9 can be precisely defined.

As shown as FIG. 1, the diameter of the cap 6 increases relatively strongly toward the grip end of the tool handle. The end face 20 of the cap 6 is provided with a dome-shaped centering recess 7. The transitional surface 21 is rounded to thereby provide a good support for the palm of the hand. Ease of rotation of the cap on the tool handle is also achieved by the use of synthetic plastic materials for the handle body and for the cap which in combination have good sliding characteristics. Suitable materials include ABS plastic, polypropylene, polyamide, and similar synthetic materials.

Figure 5:
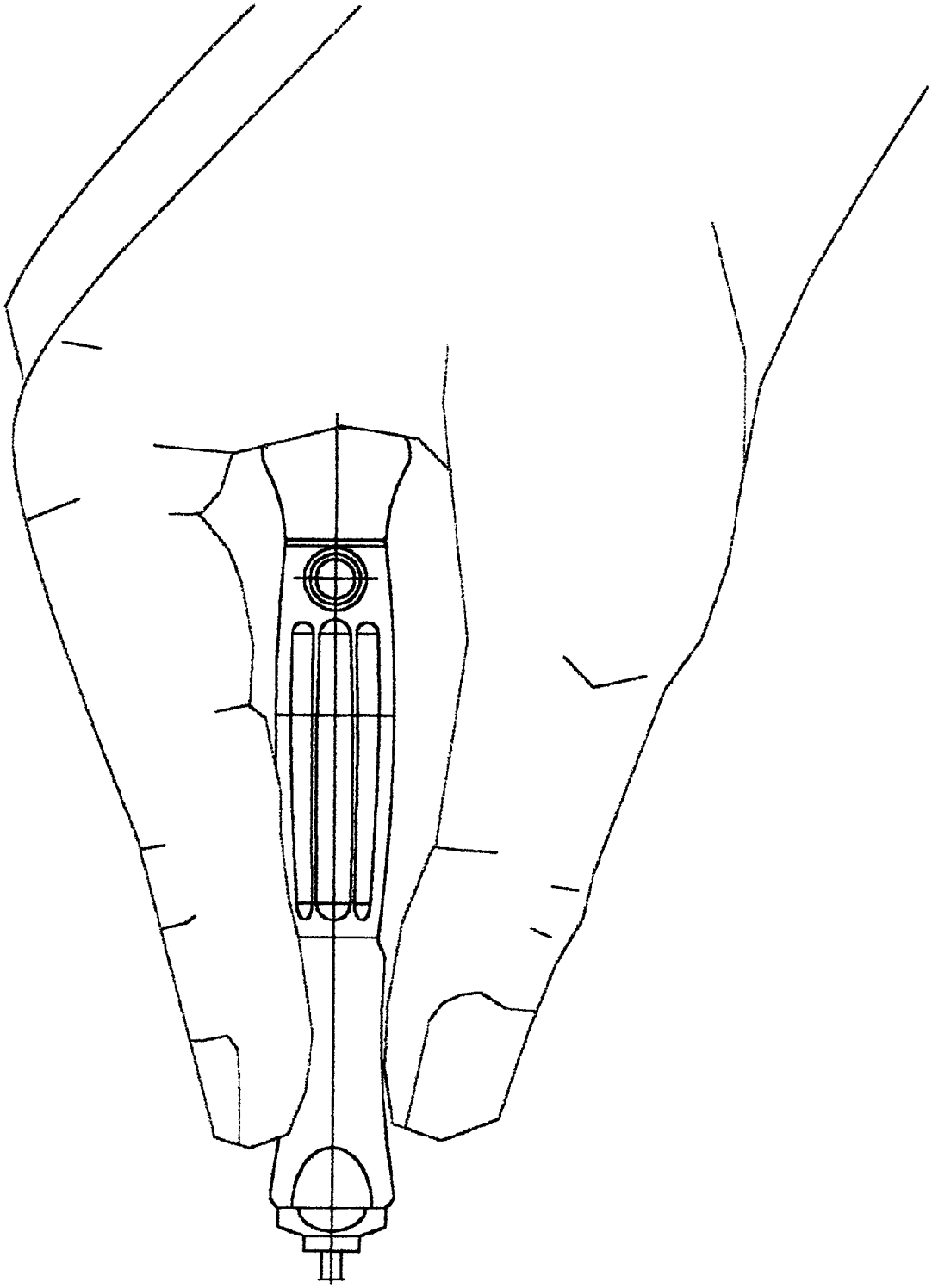

When the handle is used in conjunction with an electronic screwdriver, the screwdriver may be held in three preferred positions. In a first position (shown in FIG. 4; hand not necessarily to scale) used when turning screws or other workpieces quickly with low torque, the handle may be centered by placing the tip of the index finger in the recess on the cap of the handle. The hand then may be rotated using the thumb and middle digit. In a second position (shown in FIG. 5; hand not necessarily to scale) used when applying relatively greater torque to a workpiece, the handle may be positioned such that the cap rests against the palm of the hand. In this second position the handle may be rotated primarily by using the thumb and index finger, the remaining three fingers being placed near the grip end where they may help to induce additional torque. The concave portion of the handle thus should be sized so as to provide a comfortable gripping surface for the thumb and fingers, and the convex portion should be sized so as to allow the remaining three fingers to rest comfortably thereon. For relatively rare high-torque applications, the handle may be gripped in a third position (not shown) with the palm and finger circumventing the handle in full length, the handle being disposed generally perpendicular to the fingers.

It is thus seen that the invention satisfies the foregoing general object. The invention provides a versatile handle for a screwdriver or other hand tool. The handle can accommodate low-, medium-, and high-torque applications.

While particular embodiments of the invention have been shown, it should understood that the invention is not to be limited thereto inasmuch as modifications may be made that do not depart from the spirit and scope of the invention.

What is claimed is:

1. A tool handle body having a longitudinal dimension, said tool handle body having a distal end and a proximal end, the tool handle body having a convex portion proximal said proximal end and a concave portion comprising substantially all of the remaining portion of said tool handle body proximal said distal end, said concave portion having a surface that is soft relative to the surface of said convex portion, said tool handle body having a rotating cap disposed at said proximal end, said tool handle body including a shaft extending from said proximal end, and said cap including a bore for receiving said shaft, said cap including a handle end face, said handle end face including at least one recess disposed proximal said bore.

2. A tool handle according to claim 1, said concave portion having a generally circuloid cross section.

3. A tool handle according to claim 1, said convex portion being provided with a plurality of gripping flats.

4. A tool handle according to claim 1, said convex portion including a transverse hanging hole.

5. A tool handle according to claim 1, said tool handle including a pair of flats disposed at radially opposed positions on the handle proximal said distal end.

6. A tool handle according to claim 1, said shaft including a retaining ring, said bore having a generally annular recess for receiving said retaining ring thereby providing a snap-fit connection between said shaft and said tool handle body.

7. A tool handle according to claim 6, wherein said cap has a non-uniform diameter that increases in the direction of the proximal end.

8. A tool handle according to claim 7, wherein said cap has a proximal end face and a dome-shaped recess in said grip end face.

9. A tool handle according to claim 8, wherein said cap has an outer contour, wherein said outer contour has a rounded transitional surface.

10. A tool handle according to claim 1, said handle end face includes a plurality of recesses, said recesses being generally segment-shaped and being spaced radially outwardly from said bore.

11. A tool handle according to clam 1, said proximal portion extending over approximately ⅗ of the handle's length and said distal portion extending from the handle's end of approximately ⅖ of the handle's length.

12. A tool handle comprising a tool handle body having a longitudinal dimension, said tool handle body having a distal end and a proximal end and a rotating cap disposed at said proximal end, said tool handle body including a shaft extending from said proximal end, said shaft including a retaining ring, and said cap including a bore for receiving said shaft, said bore having a generally annular recess for receiving said retaining ring thereby providing a snap-fit connection between said cap and said tool handle body, said cap including a handle end face, said end face including at least one recess disposed proximal said bore.

13. A tool handle according to claim 12, wherein said handle end face includes a plurality of recesses, said recesses being generally segment-shaped and being spaced radially outwardly from said bore.

14. A tool handle according to claim 12, said tool handle body having a convex proximal portion extending over approximately 3/5 of the handle's length and a concave distal portion extending from the handle's end of approximately 2/5 of the handle's length, said concave portion having a surface that is soft relative to the surface of said convex portion.

* * * * *